United States Patent [19]

Byrt et al.

[11] 4,324,397

[45] Apr. 13, 1982

[54] STACKING DEVICES AND PLATFORMS THEREFOR

[75] Inventors: Graham A. Byrt; Bernard A. Graves, both of Bristol, England

[73] Assignee: Masson Scott Thrissell Engineering Limited, Bristol, England

[21] Appl. No.: 194,151

[22] PCT Filed: Sep. 7, 1979

[86] PCT No.: PCT/GB79100148

§ 371 Date: May 8, 1980

§ 102(e) Date: Apr. 28, 1980

[87] PCT Pub. No.: WO80/00560

PCT Pub. Date: Apr. 3, 1980

[30] Foreign Application Priority Data

Sep. 8, 1978 [GB] United Kingdom ..... 36082/78

[51] Int. Cl.[3] ..... B65H 31/10; B65H 31/20

[52] U.S. Cl. ..... 271/217; 271/223; 108/77; 414/98; 414/900

[58] Field of Search ..... 271/217, 218, 219, 223, 271/224, 207, 213, 214, 215, 171, 147, 148, 220, 157, 158, 159; 414/98, 97, 99, 100, 900; 108/54.1, 77

[56] References Cited

U.S. PATENT DOCUMENTS

| | | | |
|---|---|---|---|
| 1,183,627 | 5/1916 | Broadmeyer | 271/217 |
| 1,560,470 | 11/1925 | Hitchcock | 271/147 |
| 1,823,042 | 9/1931 | Hartmann | 271/223 |
| 2,946,083 | 7/1960 | Fryar et al. | 108/77 X |
| 3,131,819 | 5/1964 | Ducayet | 271/215 X |
| 4,111,411 | 9/1978 | Graves et al. | 271/218 X |
| 4,136,864 | 1/1979 | Obenshain | 271/217 |
| 4,245,834 | 1/1981 | Songer et al. | 271/223 X |

FOREIGN PATENT DOCUMENTS

| | | |
|---|---|---|
| 2028719 | 12/1970 | Fed. Rep. of Germany . |
| 2633897 | 2/1977 | Fed. Rep. of Germany . |

*Primary Examiner*—Bruce H. Stoner

*Attorney, Agent, or Firm*—Seidel, Gonda, Goldhammer & Panitch

[57] ABSTRACT

A platform, for use in a sheet stacking device in which the platform descends as a stack being formed on it grows higher, is so constructed that its length can be varied according to the length of sheets to be stacked. The platform is made in two or more sections (10, 11, 12) each hinged (15, 17) to the next, and all sections are supported horizontally to receive long sheets, less than all the sections being horizontal and the remaining sections hanging vertically when shorter sheets are being stacked. Wheels (13, 16, 18) may be provided on the platform so that it may easily be moved out of the stacking device when loaded, all the sections being restored to a horizontal position for such movement.

9 Claims, 6 Drawing Figures

STACKING DEVICES AND PLATFORMS THEREFOR

This invention relates to sheet stacking devices and more particularly to platforms on which stacks of sheets may be formed. It is common to employ such a platform in a sheet stacking device, the platform being lowered as a stack being formed on the platform increases in height so that the top of the growing stack remains at a substantially constant level as successive sheets are fed on to it. The feed of sheets is normally along a substantially horizontal path above the stack being formed; each sheet is projected by feed rollers or belts from one side of the stack to pass over the stack a small distance above its top until the leading edge of the sheet strikes a vertical surface of a "backboard" at the opposite side of the stack, the horizontal movement of the sheet stops and the sheet falls on to the stack.

The distance between the feed rollers or belts and the backboard has to be set according to the length (measured in the direction of travel) of the sheets to be stacked, and when the length of the sheets being stacked is less than the maximum length that the stacking device can handle, either the backboard or the feed rollers or belts overlaps part of the platform (as the latter must be at least as long as the maximum sheet length). Such overlap is inconvenient. Also the operator needs to watch the stacking operation and the most convenient position for this is behind the backboard where often some machine controls are placed. To reach this position with different sheet lengths the operator usually has to stand on the platform, sometimes on a wooden box, and where the platform includes a wheeled trolley this could be dangerous. Alternatively sections of the platform may be removable, which is a time consuming operation.

It is an object of the present invention to provide an improved stacking device, specifically a platform so arranged that these inconveniences are avoided.

According to the invention there is provided a platform for a sheet stacking device constructed so that its length can be varied in which said platform comprises at least two sections, each of said sections having a pivotal connection to the next section. Preferably said pivotal connection is a hinge connection, the pivotal axis of each hinge connection extending at right-angles to the length of the platform. When sheets of the maximum length are to be stacked, both or all sections of the platform are supported in horizontal alignment but if sheets of a shorter length are to be stacked, one or more of the sections may not need to be so supported and this section or sections hangs down on its hinge connection to the supported section or sections.

The invention may also be embodied in a sheet stacking device having a platform as set out above, together with lowering means with which one or more of the platform sections may be engaged, said lowering means being adapted to raise the platform to bring its thus engaged section or sections to a level at which sheets may be received from a sheet feeder and to lower the platform as a stack of sheets accumulates thereon, the section or sections not thus engaged hanging from the engaged section or sections while the latter is/are raised in which said lowering means includes two support beams, disposed parallel to the direction of motion of sheets arriving in the stacking device, and spaced apart by slightly more than the width of the platform.

Each beam may have a plurality of support stubs projecting horizontally towards the other beam, the number and spacing of the stubs being related to the number and lengths of the platform section; the platform may be so positioned relative to the stubs that all the platform sections may be supported, or the platform may be displaced lengthwise relative to the stubs and beams so that one or more sections are not supported. In the latter case, when the beams are lifted to raise the platform the unsupported platform sections hang down from one end of the supported section or sections; when the beams are fully lowered, the platform is required to be at floor level and the hanging section or sections must be restored to the horizontal position. Conveniently this can be done by a rope or chain having one end secured to the free end of a bar pivotally connected at its other end to one of the beams, and the other end secured to an anchorage so placed as to be above said free end when the hanging sections are restored to the horizontal. The platform may conveniently be provided with at least one pair of wheels on each of its sections so that, after a stack of sheets has been formed upon it, it may be moved away and a similar platform may be brought into position between the beams to be raised and to have a further stack of sheets formed upon it.

In order that the invention may be well understood, a preferred embodiment thereof will now be described, with reference to the accompanying diagrammatic drawings, in which.

Figure 1:
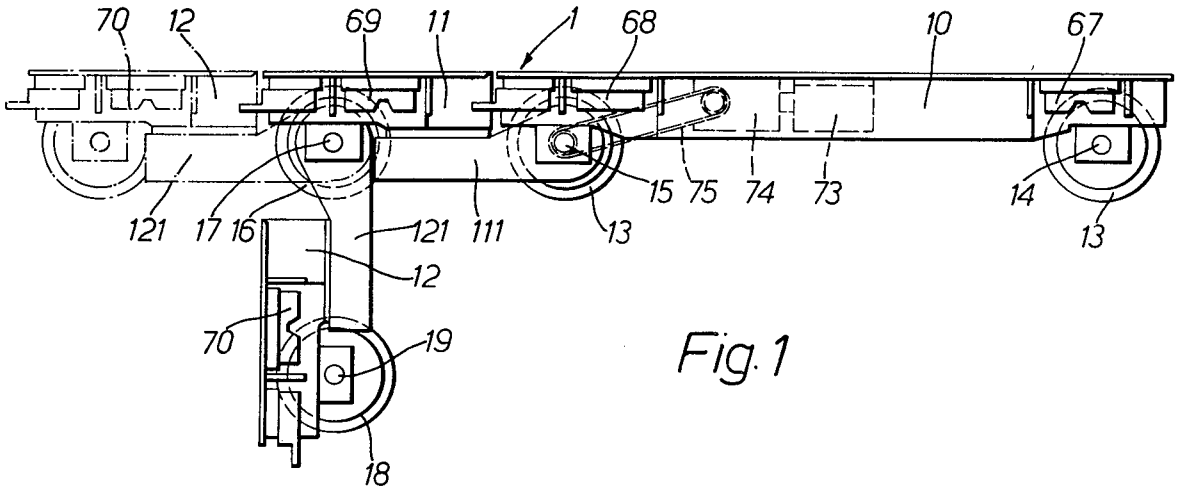
FIG. 1 is a side elevation of a platform embodying the invention.

First referring to FIG. 1, a platform 1 is shown which comprises three sections 10, 11, 12, the right-hand section 10 is a long section and the sections 11, and 12 are equal in length to one another and each less than half the length of the section 10. The long platform section 10 is provided with two pairs of wheels 13 mounted under its end portions on axles 14, 15. The short platform section 11 is provided with a pair of wheels 16 under its end portion remote from the section 10 and similarly the short platform section 12 has a pair of wheels 18 under its end portion remote from the section 11, the wheels 16, 18 being respectively mounted on axles 17, 19.

Hinge connections are provided between adjacent sections of the platform, i.e. between section 10 and section 11 and section 12. The axles 15, 17 serve as pivot pins of the hinge connections. Each of the short platform sections 11, 12 has a respective extension 111, 121 to the right (as seen in FIG. 1) under the adjacent end portions of the sections 10, 11 respectively, these extensions being journalled on the axles 15, 17 respectively.

As shown in full line in FIG. 1, only the platform sections 10, 11 are supported (by means to be described later) in a horizontal position; the short section 12 therefore hangs vertically from its hinge connection, through axle 17, to the section 11. The length of the platform is thus equal to the combined length of sections 10, 11. If the section 12 were also supported horizontally, it would be in the position shown in broken line and the length of the platform would be equal to the combined length of all three sections. It is possible also to support only the long section 10 in the horizontal position, allowing both the short sections 11, 12 to hang vertically from the hinge connection through axle 15.

Figure 2:
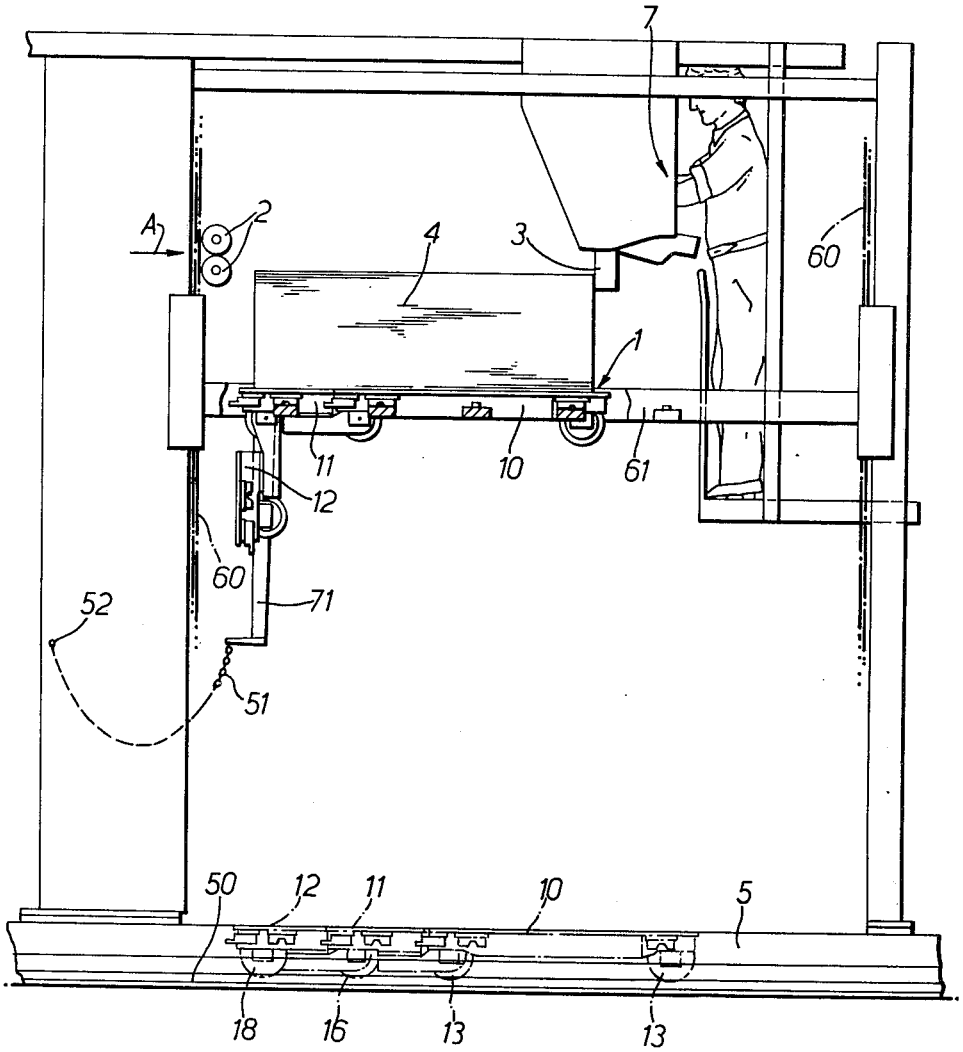
FIG. 2 is a side elevation of a stacking device including the platform of FIG. 1.
Figure 3:
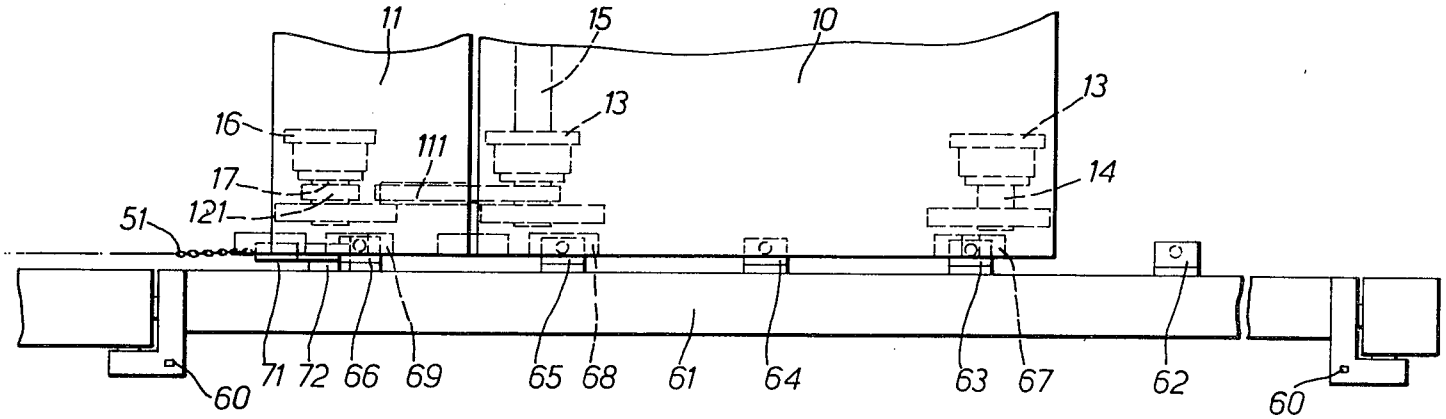
FIG. 3 is a plan view of part of the device of FIG. 2.

In FIGS. 2 and 3 is shown a sheet stacking device including the platform 1 described above. Sheets are fed to the device between pairs of rollers 2 in the direction shown by the arrow A. Each sheet leaving the rollers 2 is travelling at sufficient speed to continue in a substantially horizontal path to the right until it strikes a vertical face of a backboard 3; this stops the sheet which then falls.

Below the path of the successive sheets from the rollers 2 to the backboard 3, a stack 4 forms as each successive sheet falls on to the preceding sheet. The growing stack 4 is carried by the platform 1, which is lowered progressively at the same rate as that at which the height of the stack increases; this maintains a constant vertical spacing between the top of the stack 4 and the path of sheets from the belts 2 to the backboard 3, as is required.

The sheets forming the stack 4 are longer than the platform section 10, but shorter than the combined length of the sections 10, and 11. As shown in FIG. 2, therefore, only the sections 10, 11 are supported in the horizontal position; the section 12 is hanging from its hinge connection to section 11. When the stack 4 is complete, feeding of sheets is stopped and the platform 1 is lowered to the base 5 of the stacking device, where a pair of rails 50 are provided to receive the wheels 13, 16, 18. Upon reaching the rails 50, it is necessary for all sections of the platform 1 to be horizontal. To achieve this, positioned on each side of the platform when the latter is receiving sheets thereon, is a chain or cable 51 connected between an anchorage 52 and one end of a bar 71 pivotally attached, at its other end, to mechanism for raising and lowering the platform, to be described later. The two anchorages 52 are at a higher level than the rails 50 and the length of the chains or cables 51 is such, having regard to the position of the anchorages 52, that as the platform 1 is lowered, the chains or cables become taut before the platform has fully lowered and the bars 71 are swung about their respective pivotal attachments so that they both engage the section 12 and pull the latter into the horizontal position as lowering of the platform 1 is completed.

The platform 1 is raised and lowered by four chains 60 which are linked in pairs by two beams 61, only two of the chains being visible in FIGS. 2 and 3. The beams 61 are disposed parallel to the rails 50 and are spaced apart by a distance slightly greater than the width (normal to the plane of FIG. 2) of the platform 1. The beams are longer than the overall length of the platform 1 (with all its sections horizontal) and project beyond the platform at each end, the chains 60 being disposed vertically and attached to the projecting ends of the beams so that all parts of the chains and beams are clear of the stack 4 during its formation on the platform.

The other ends of the bars 71 are respectively pivotally attached, at 72 (see FIG. 3), to a different one of the beams 61, the pivot 72 being aligned with one of the axles 15, 17 depending on the position of the platform 1.

Each beam 61 has five platform engaging lifting stubs 62, 63, 64, 65 and 66 projecting horizontally from the beam so as to be engageable with blocks fixed to the underside of the platform (see also FIG. 3). The section 10 has two blocks 67, 68 fixed on each side thereof, the section 11 has one block 69 fixed on each side thereof and the section 12 has one block 70 fixed on each side thereof. Each of the stubs 62 to 66 is provided on its upper face with a conical projection and to prevent any movement of the platform whilst the latter is being raised or lowered the conical projections engage into respective mating recesses in the bottom faces of the blocks 67 to 70. When the platform 1 has its wheels on the rails 50 and all its length is between the beams 61, three stubs 62, 63, 64 from each beam project under the long platform section 10, one stub 65 from each beam under the short platform section 11, and the remaining stub 66 from each beam under the section 12. With the platform so positioned, lifting of the beams 61 by chains 60 causes stubs 62, 64, 65, 66 to engage blocks 67, 68, 69, 70 respectively and thus raises the platform 1 with all its sections horizontal, so that the whole platform is available to receive long sheets.

If medium-length sheets are to be stacked, i.e. sheets no longer than the combined length of platform sections 10 and 11, then the platform 1, when it is moved along the rails 50 from the left, is stopped when the blocks 67, 68 of the platform section 10 are respectively above the stubs 63, 65 of the two beams; the blocks 69 of section 11 are then above the stubs 66, no stubs are below the section 12, no part of the platform is above the stubs 62, and no blocks are above the stubs 64. With the platform so placed, when the beams 61 are lifted to raise the platform, the sections 10, 11 will be held horizontal to receive sheets, section 12 hanging (as in FIGS. 1 and 2). For stacking short sheets, for which the platform section 10 is long enough it will be understood that the platform is stopped when the blocks 67, 68 of section 10 are respectively above stubs 64, 66 so that when the platform is raised both the sections 11, 12 hang vertically as there are no stubs under them.

It will be appreciated that the use of the platform 1 as described above enables the backboard 3 to be moved to the left without difficulty when medium-length or short sheets are to be stacked, as the horizontal length of the platform 1 during stack formation will be less than its maximum length. This is particularly helpful when, as is common, an operator's position 7 is associated with, and movable with, the backboard 3.

If the stacking device is arranged so that the rollers 2 are movable to adjust the spacing between the rollers 2 and backboard 3, then the platform 1 may be used with the long section 10 at the left, the short sections 11, 12 at the right; the chain or cable 51 and its anchorage 52 will then also be at the right of the stacking device and the disposition of the stubs 62, 63, 64, 65, 66 on the beams 61 will be reversed.

To facilitate the movement of the platform 1 along the rails 50, when a completed stack of sheets is being removed and when the platform is moved into the stacking device, the platform is arranged to be self-propelled. The long platform section 10 carries on its underside a motor 73, arranged to drive the axle 15 and hence the wheels 13 on axle 15. Transmission of drive from motor 73 to axle 15 is effected by a gearbox 74 and a chain drive 75. In view of this the axle 15 necessarily extends across the width of the platform and has one of the wheels 13 secured to it adjacent to each of its ends. The axles 14, 16, 19 however need not extend across the width of the platform, and preferably are stub axles each carrying one wheel.

Figure 5:
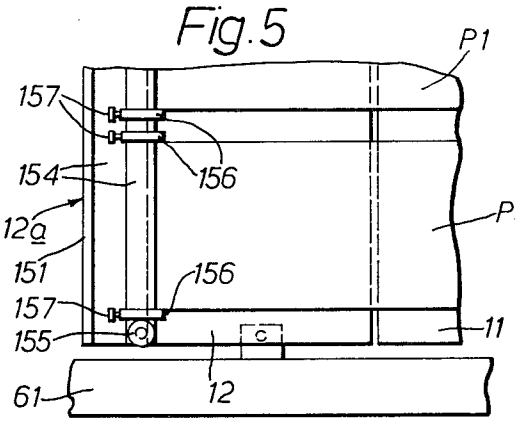
FIG. 5 is a plan view of part of FIG. 4.
Figure 4:
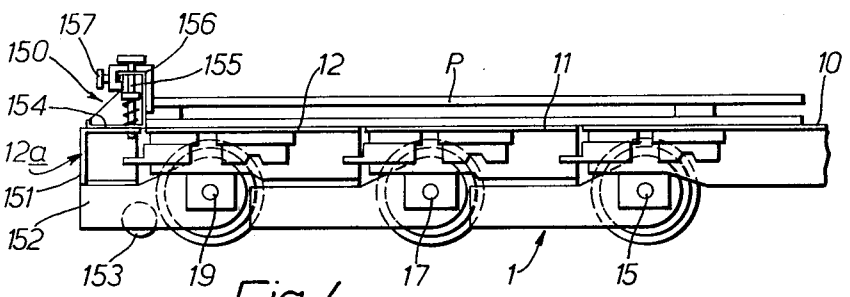
FIG. 4 is a side elevation of part of a modified form of the platform shown in FIG. 1.

It is usual to form the stack of sheets on a pallet so that the completed stack may conveniently be handled by, for example, a fork lift truck. Referring now to FIGS. 4 and 5, a modified form of platform 1 is shown with a pallet P of known form on its upper surface. As shown, all the sections 10, 11 and 12 will remain horizontal when the platform 1 is lifted by the beams 61. To enable the operator to place the pallet in the required position on the platform ready to receive sheets thereon as described above, he releasably fixes a gauge bar 150 across the platform.

For this purpose the platform 1 is provided with an additional section 12*a* comprising a U-shaped girder 151 lying on one side and carried on extensions 152 which extend under the adjacent end portion of section 12, the extensions being journalled on the axles 19 so as to form a hinge connection between the sections 12 and 12*a*. The section 12*a* also has a pair of wheels 153 positioned so that the upper face of the girder 151 is in alignment with the top of the sections 10, 11 and 12 when the platform is positioned on the rails 50.

The gauge bar 150 comprises a beam 154 provided near each end thereof with a vertical bolt 155 threaded at its lower end. Slidably mounted on the beam 154 are a number of settable markers 156 which may be clamped at desired positions along the beam by means of screws 157. Two threaded holes 158 are provided in the upper face of girder 151 (FIG. 6), and similar holes 159, 160 are provided respectively in the upper faces of platform sections 11 and 12.

The operator places the bar 150 on the section 12*a* and screws the bolts 155 into the holes 158, the right hand face of the beam 154 then forming a stop against which a pallet is placed. This positions the pallet correctly in the lengthwise direction to receive large sheets which require all sections 10, 11 and 12 to remain horizontal when the platform is lifted as described above. It often happens that a number of stacks are formed simultaneously side by side across the width of the platform 1. In such a case a separate pallet is placed on the platform to support each stack, and to ensure that the pallets are placed in the correct positions across the platform the markers 156 are first clamped in the required positions along the beam 154 to indicate the pallet positions. This is illustrated in FIG. 5 which shows two pallets P and P1. As the platform of FIG. 4 is lifted by the beams 61 the section 12*a* hinges downwardly about axles 19 so that it does not impede the flow of sheets as they are fed on to the platform.

If the sheet length is such that section 12 is not required to support the stack, the gauge bar 150 is placed on the section 12 and the bolts 155 screwed into holes 160; and if it is such that only section 10 is required to support the stack, the gauge bar is placed on to section 11 and bolts 155 screwed into holes 159.

As the lowering of a platform, as shown in FIGS. 4 and 5, is completed the section 12*a* will be moved to the horizontal position by the bars 71 in the same way as the sections 11 and 12.

Figure 6:
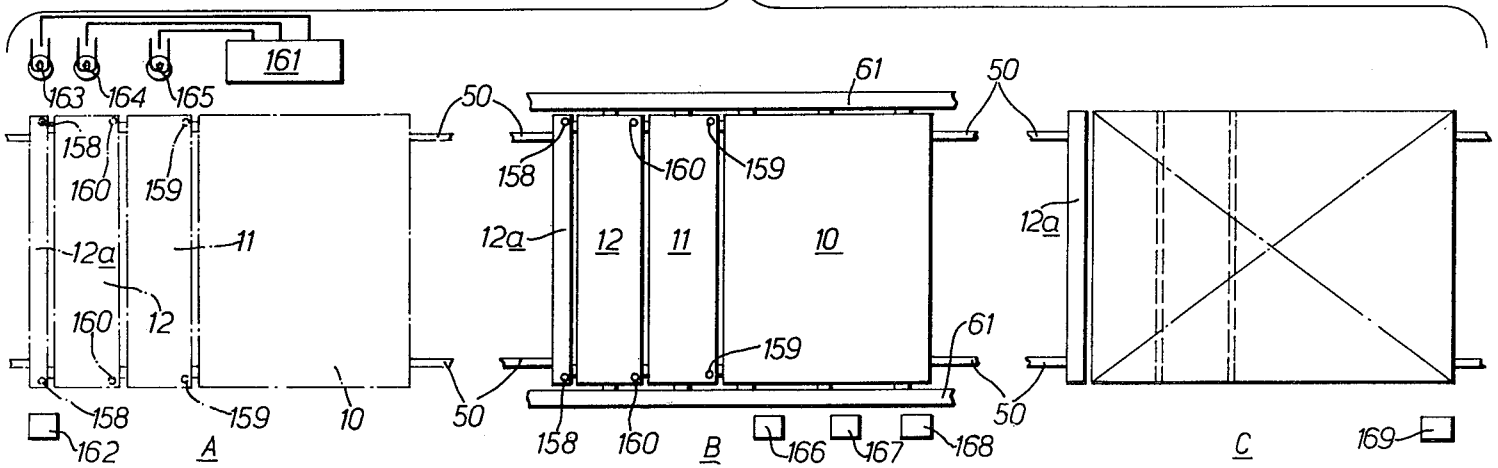
FIG. 6 is a diagrammatic plan view showing the different positions occupied by the platform of FIG. 4 when included in the stacking device of FIG. 2.

Referring now to FIG. 6 three positions A, B, and C indicating different positions occupied by a platform 1 during one cycle of operation of the stacking device are shown. Position A is the area where the platform 1 is prepared for receiving sheets by having one or more pallets placed on it, position B is the position in the stacking device from which the platform is lifted and to which it is returned by the beams 61 as described above, and position C is where completed stacks are removed from the platform.

The motor 73 is most conveniently an electric motor and the platform may be provided with any conventional current pick-up devices for bringing an electric current supply to the motor. The energisation of the motor 73, and hence the movement of the platform along rails 50, may be controlled by the operator of the stacking device; in large measure however, such control may be automatic from a control device 161 which may, for example, be a micro-processor.

In operation, and assuming that a loaded first platform 1 is in position C and a second platform is being loaded with sheets as described above, the platform at C is unloaded and moved along rails 50, under the second platform to position A at which it is stopped when its presence is detected by a sensor 162. Whilst the first platform is at position A the operator fixes a gauge bar 150 into position, as described above, To indicate which platform section (i.e. 11, 12, or 12*a*) the bar 150 is to be fitted to, one of three lamps 163, 164, 165 is switched on by the control device 161 according to data fed into the latter (e.g. sheet length).

After loading of the second platform has been completed, it is lowered to position B and then moved to position C to be unloaded. The first platform at position A is then moved to position B in the stacking device. The arrival of the platform at the desired position relative to the beams 61 is detected by one of three sensors 166, 167 and 168. The latter each correspond to one of the three positions at which the platform may be required to stop, according to whether the whole length of the platform (i.e. all three sections 10, 11, 12) or only part of its length (i.e. sections 10 and 11 or section 10 alone) is to be supported horizontally during stack formation. The control device responds to whichever one of the sensors 166, 167, 168 corresponds to the length of sheets to be stacked. Upon completion of the stack and lowering of the platform the same sensor, or a further sensor, may detect when the platform is again supported by the rails 50 and may control energisation of motor 73 to propel the platform to position C at which it is stopped when its presence is detected by a sensor 169. Although not shown, it will be understood that all the various sensors are connected to the control unit 161.

There can be any number of sections making up the platform and in a further modified form the platform would be constructed in the manner of a roller shutter.

We claim:

1. A sheet stacking device including a sheet feeder, a platform constructed so that its effective length can be varied, said platform comprising at least two sections pivoted together, the axis of each pivot extending horizontally at right angles to the length of the platform, means for supporting said platform in a horizontal plane, and lifting means adapted to engage with one or more of the platform sections forming said effective length of the platform, to raise the platform to bring its thus engaged section or sections to a level at which sheets may be received from said sheet feeder and to then lower the platform as a stack accumulates thereon, the section or sections not thus engaged hanging down from the engaged section or sections.

2. A sheet stacking device as claimed in claim 1 in which said lifting means includes two support beams extending parallel to the direction of motion of sheets arriving in the stacking device and arranged so as to engage opposite sides of the thus engaged section or sections whilst said platform is raised and lowered.

3. A sheet stacking device as claimed in claim 2 in which each of said beams has a plurality of support stubs projecting horizontally towards the other beam, the number and spacing of the stubs being related to the number and lengths of the platform sections.

4. A sheet stacking device as claimed in claim 1 including means to drive said platform along said support means, and means for controlling said drive means so that said platform may be positioned relative to said lifting means so that one or more of said sections are engaged by said lifting means when the latter is raised.

5. A sheet stacking device as claimed in claim 4 in which each of said sections is provided with at least one pair of wheels.

6. A sheet stacking device as claimed in claim 5 in which said drive means is mounted on one of said sections and is connected to one pair of its associated wheels.

7. A sheet stacking device as claimed in claim 5 or claim 8 in which said support means includes a pair of parallel rails spaced to receive the pairs of wheels of the platform sections so as to permit movement of said platform along said rails by said drive means.

8. A sheet stacking device as claimed in claim 1 including means for swinging a section not engaged with said lifting means towards a horizontal position as said platform, during lowering thereof, approaches said support means.

9. A sheet stacking device as claimed in claim 8 in which said swinging means comprises a bar pivotally connected at one end to said lifting means, and flexible means connected between the other end of said bar and a fixed point positioned above said support means such that as said lifting means lowers said platform the flexible means becomes taut and causes said bar to swing about its pivot and contact the section or sections not engaged by said lifting means and swing them into a horizontal position as said platform approaches said support means.

* * * * *